US006658775B1

(12) United States Patent
Lanzisero

(10) Patent No.: US 6,658,775 B1
(45) Date of Patent: Dec. 9, 2003

(54) TOLL PASS DISPLAY ASSEMBLY AND SYSTEM

(76) Inventor: Anthony Lanzisero, 330 Pinebrook Rd., Manalapan, NJ (US) 07726

( * ) Notice: Subject to any disclaimer, the term of this patent is extended or adjusted under 35 U.S.C. 154(b) by 62 days.

(21) Appl. No.: 09/796,169

(22) Filed: Feb. 28, 2001

(51) Int. Cl.[7] ..... G09F 7/00; G09F 21/04

(52) U.S. Cl. ..... 40/593; 40/597; 40/605; 40/611.01

(58) Field of Search ..... 40/593, 591, 597, 40/605, 611.01, 618; 160/DIG. 13; 292/DIG. 28

(56) References Cited

U.S. PATENT DOCUMENTS

| | | | | | |
|---|---|---|---|---|---|
| 1,645,229 | A | * | 10/1927 | Churmusi | 40/653 |
| 1,883,791 | A | * | 10/1932 | Jewell | 40/597 |
| 1,920,185 | A | * | 8/1933 | Carr, Jr. | 296/97.7 |
| 3,237,330 | A | * | 3/1966 | Dinstbir | 40/593 |
| 3,531,880 | A | * | 10/1970 | Ramee | 40/593 |
| 4,118,878 | A | * | 10/1978 | Semon | 36/59 C |
| 5,080,309 | A | * | 1/1992 | Ivins | 248/205.8 |
| 5,080,941 | A | * | 1/1992 | Kosowan | 40/597 |
| 5,099,594 | A | * | 3/1992 | Reas et al. | 40/593 |
| 5,176,357 | A | * | 1/1993 | Hobart | 160/DIG. 13 |
| 5,241,768 | A | * | 9/1993 | Thompson | 40/593 |
| 5,430,965 | A | * | 7/1995 | Lai | 40/593 |
| 5,528,773 | A | * | 6/1996 | Lowinger | 2/161.4 |
| 5,960,572 | A | * | 10/1999 | DeVito | 40/593 |
| 6,211,808 | B1 | * | 4/2001 | Rees | 342/29 |
| 6,367,182 | B1 | * | 4/2002 | Olson, Jr. | 40/593 |
| 6,375,143 | B1 | * | 4/2002 | Burns | 40/593 |

* cited by examiner

*Primary Examiner*—Dennis H. Pedder
*Assistant Examiner*—H. Gutman
(74) *Attorney, Agent, or Firm*—Edward P. Dutkiewicz

(57) ABSTRACT

A toll pass display assembly comprises a mounting plate, a suction cup and coupler. The mounting plate is fabricated of a relatively hard material and has a generally rectangular configuration. It has a front surface and a rear surface. There is a long top edge with a parallel bottom edge and two parallel side edges there between. There is next provided a suction cup which is fabricated of a flexible elastomeric material. The suction cup has an internal generally spherical concave surface and an external generally spherical convex surface with a round circumferential edge there between. Lastly, there is provided a suction cup coupler. The coupler is fabricated of the same type of flexible elastomeric material as the suction cup and formed integrally therewith. The coupler has a front section coupled to the mounting plate. A pair of hook and loop fastener strips are coupled to the front surface of the mounting plate.

1 Claim, 3 Drawing Sheets

FIG 5
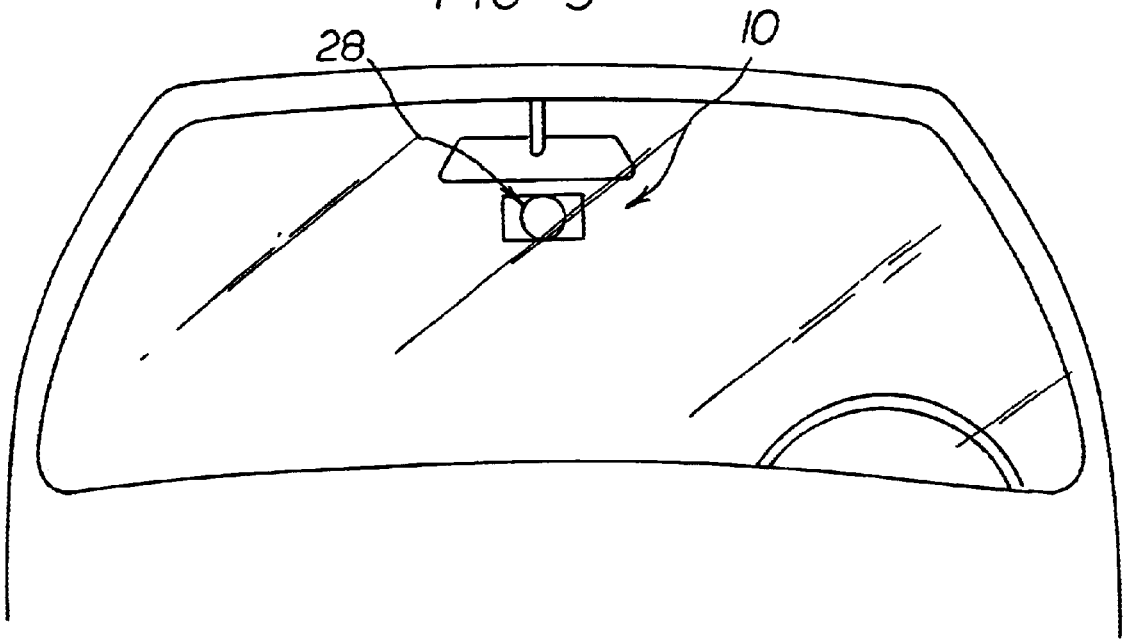
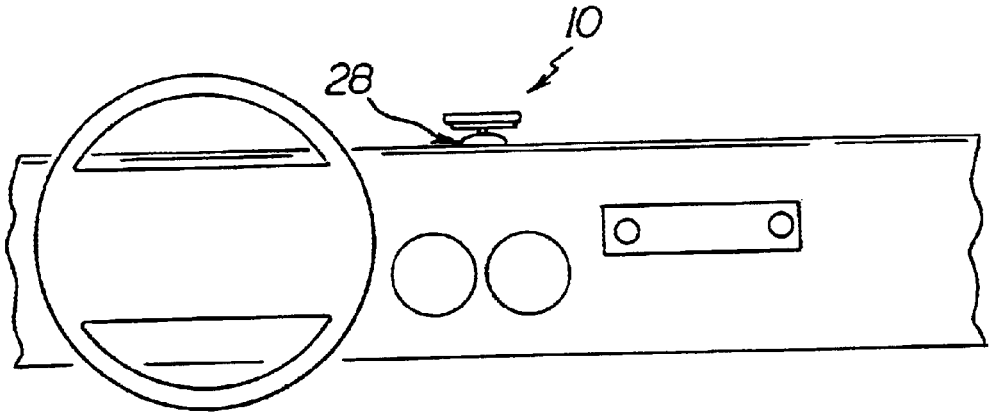
FIG 6

TOLL PASS DISPLAY ASSEMBLY AND SYSTEM

BACKGROUND OF THE INVENTION

1. Field of the Invention

The present invention relates to a toll pass display assembly and system and, more particularly, pertains to removably retaining a toll pass in position for being scanned when driving a vehicle.

2. Description of the Prior Art

The use of other vehicle pass holders of known methods and apparatuses is known in the prior art. More specifically, other known vehicle pass holders of known methods and apparatuses previously devised and utilized for the purpose of holding toll pass card in place are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,531,880 issued Jan. 8, 1969 to Ramee discloses a combination identification display and gate key card. U.S. Pat. No. 3,533,178 to Strohmair issued Jun. 3, 1968 discloses a holder for registration certificate. U.S. Pat. No. 5,016,145 issued May 14, 1991 to Singleton discloses an illuminated display vehicle ornament with various coupling means. U.S. Pat. No. 5,099,594 issued MaR. 31, 1992 to Reas et al discloses a vehicle mounted message display with suction cups and interposed hook and loop fasteners. U.S. Pat. No. 5,423,140 issued Jun. 13, 1995 to Nuspl discloses a two sided display for changeably displaying identical indicia. U.S. Pat. No. 5,960,572 issued Oct. 5, 1999 to DeVito discloses a toll pass holder for temporarily retaining the housing to an interior surface of a windshield. U.S. Pat. No. 5,679,045 issued Aug. 13, 1991 to Adams discloses a suction cup for use in windows.

While these devices fulfill their respective, particular objectives and requirements, the aforementioned patents do not describe a toll pass display assembly and system that allows removably retaining a toll pass in position for being scanned when driving a vehicle.

In this respect, the toll pass display and assembly system according to the present invention substantially departs from the conventional concepts and designs of the prior art, and in doing so provides an apparatus primarily developed for the purpose of removably retaining a toll pass in position for being scanned when driving a vehicle.

Therefore, it can be appreciated that there exists a continuing need for a new and improved toll pass display system which can be used for removably retaining a toll pass in position for being scanned when driving a vehicle. In this regard, the present invention substantially fulfills this need.

SUMMARY OF THE INVENTION

In view of the foregoing disadvantages inherent in the known types of other known vehicle pass holders of known methods and apparatuses now present in the prior art, the present invention provides an improved toll pass display system. As such, the general purpose of the present invention, which will be described subsequently in greater detail, is to provide a new and improved toll pass display system and method which has all the advantages of the prior art and none of the disadvantages.

To attain this, the present invention essentially comprises a toll pass display and assembly system for removably retaining a toll pass in position for being scanned when driving a vehicle through a toll booth. The system comprises, in combination, a mounting plate, a suction cup, a gripping tab physically part of the suction cup, a suction cup coupler physically part of the suction cup, a pair of hook and loop fastener strips and a toll card. The mounting plate is fabricated of a relatively hard transparent elastomeric material. The preferred material is a clear acrylic. It and has a generally rectangular configuration with a front surface and a rear surface. There is also a long top edge and a parallel bottom edge and two parallel side edges there between. The mounting plate has a horizontal width between the side edges of between about 3 and 4 inches, preferably about 3.5 inches. It has a vertical height between the top and bottom edges of between about 1.5 and 2.5 inches, preferably about 2 inches. The mounting plate has a central aperture there through. Next provided is a suction cup which is fabricated of a flexible elastomeric material. The preferred material is an ultraviolet (UV) resistant polyvinyl chloride (PVC) compound light-diffusing safety ring so there is no hot focal point to damage nearby surfaces for UV and heat protection of the pass. The suction cup has an internal generally spherical concave surface and an external generally spherical convex surface. There is provided a round circumferential edge there between. The concave depth of the suction cup is between about 0.25 and 0.75 inches in depth, and preferably about 0.50 inches. The round circumferential edge has a diameter of between about 2.0 and 2.75 inches, and preferably about 2.25 inches. The round circumferential edge is greater than the plate height but less the plate width. Next there is provided a gripping tab extending radially outwardly from the round circumferential side edge of the suction cup. The tab physically part of the suction cup is integrally formed with the suction cup and protrudes laterally between about 0.125 and 0.375 inches, and preferably about 0.25 inches from the round circumferential side edge in a direction parallel with the side edges of the suction cup. There is next provided a suction cup coupler physically part of the suction cup which is fabricated of the same type of flexible elastomeric material as the suction cup. It is formed integrally therewith. The coupler has a front section coupled to the center of the convex surface of the suction cup and a rear section extending through the aperture of the mounting plate. The suction cup, tab and coupler are fabricated of a transparent flexible elastomeric material. The mounting plate is fabricated of a rigid elastomeric material. There is next provided a pair of hook and loop fastener strips fabricated of a transparent elastomeric material. The strips are coupled to the front surface of the mounting plate and extend from between adjacent to the bottom edge and adjacent to the top edge of the mounting plate. Each strip is between about 0.25 and 0.75 inches in width, preferably about 0.50 inches. Lastly there is provided a generally rectangular toll card. The card has a front and a rear. There is also an upper edge and parallel lower edge and two parallel side edges there between. The toll card has a pair of hook and loop fastener strips on the rear face to releasably mate with and attach to the hook and loop fastener strips of the mounting plate. The card is able to be scanned by an electronic device as the card passes through a toll booth scanning station. The card is also readily separable from the mounting plate when a driver leaves the vehicle in which it is mounted, to facilitate security of the card. In the alternative, the suction cup is detached from the vehicle so that the assembly and system may be removed from the vehicle.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved toll pass display system which has all of the advantages of the prior art other known vehicle pass holders of known methods and apparatuses and none of the disadvantages.

It is another object of the present invention to provide a new and improved toll pass display system which may be easily and efficiently manufactured and marketed.

It is further object of the present invention to provide a new and improved toll pass display system which is of durable and reliable constructions.

An even further object of the present invention is to provide a new and improved toll pass display system which is susceptible of a low cost of manufacture with regard to both materials and labor, and which accordingly is then susceptible of low prices of sale to the consuming public, thereby making such toll pass display system economically available to the buying public.

Even still another object of the present invention is to provide a toll pass display system for removably retaining a toll pass in position for being scanned when driving a vehicle.

Additional objects and advantages of the invention include:

a) single suction cup for easy, one-handed operation;

b) no moving parts; becomes part of toll pass and is removed as an assembly;

c) additional ultraviolet and heat shielding for toll pass;

d) easy portability between vehicles, rentals, lease and commercial;

e) requires no modification to the toll pass for use.

Lastly, it is an object of the present invention to provide a new and improved toll pass display assembly comprising a mounting plate, a suction cup and coupler. The mounting plate is fabricated of a relatively hard material and has a generally rectangular configuration. It has a front surface and a rear surface. There is a long top edge with a parallel bottom edge and two parallel side edges there between. There is next provided a suction cup which is fabricated of a flexible elastomeric material. The suction cup has an internal generally spherical concave surface and an external generally spherical convex surface with a round circumferential edge there between. Lastly, there is provided a suction cup coupler. The coupler is fabricated of the same type of flexible elastomeric material as the suction cup and formed integrally therewith. The coupler has a front section coupled to the mounting. A pair of hook and loop fastener strips are coupled to the front surface of the mounting plate.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 shows the toll pass display system as attached to the windshield of a vehicle, adjacent to the rear view mirror.

FIG. 6 shows the toll pass display system positioned on the dash board of a vehicle.

The same reference numerals refer to the same parts throughout the various Figures.

DESCRIPTION OF THE PREFERRED EMBODIMENT

Figure 1:
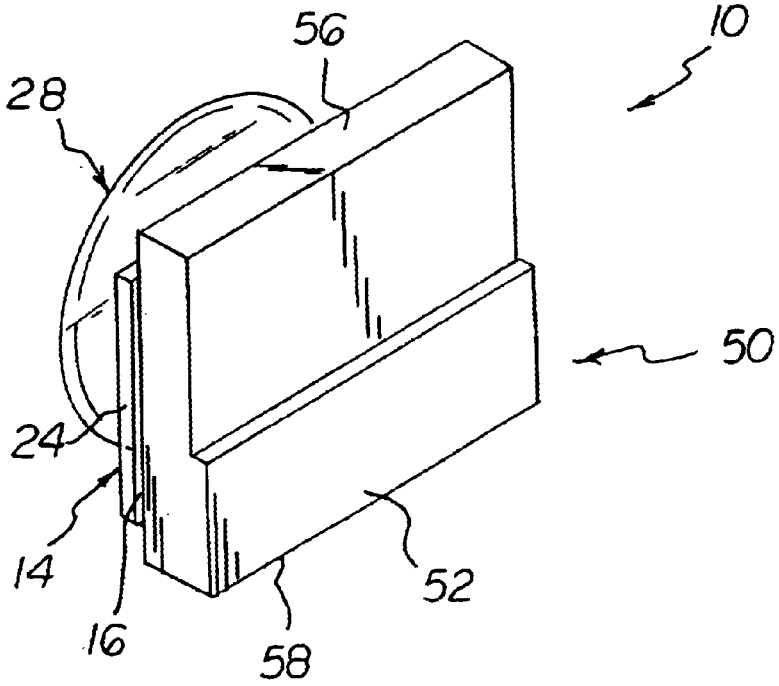
FIG. 1 is perspective view of the toll pass display system taken from the front side of the toll pass.
Figure 2:
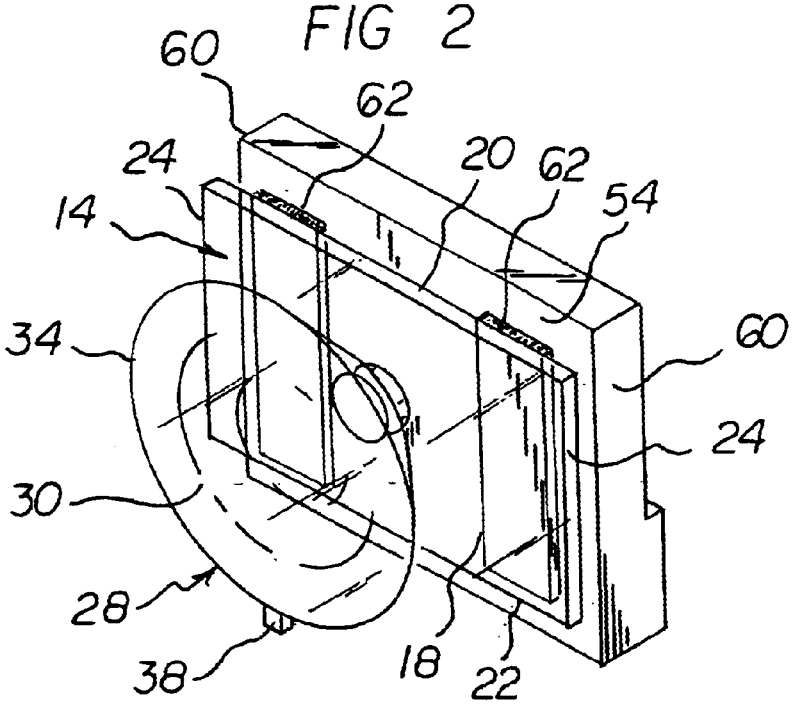
FIG. 2 is a perspective view of the toll pass display system from the rear side of the toll pass.
Figure 3:
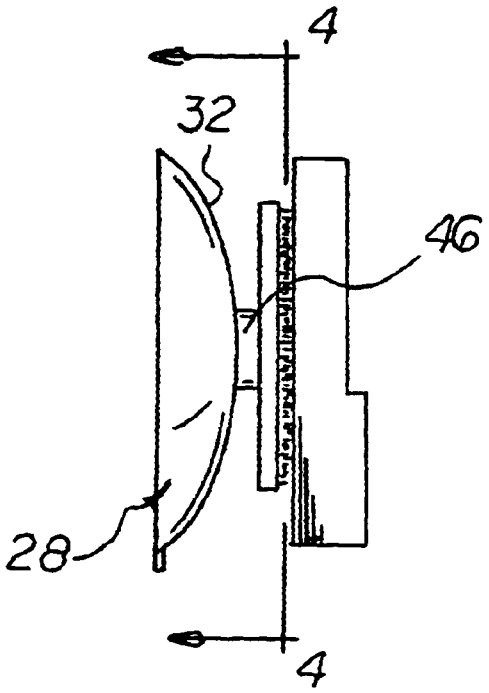
FIG. 3 is a side elevational view of the invention shown in FIGS. 1 and 2.
Figure 4:
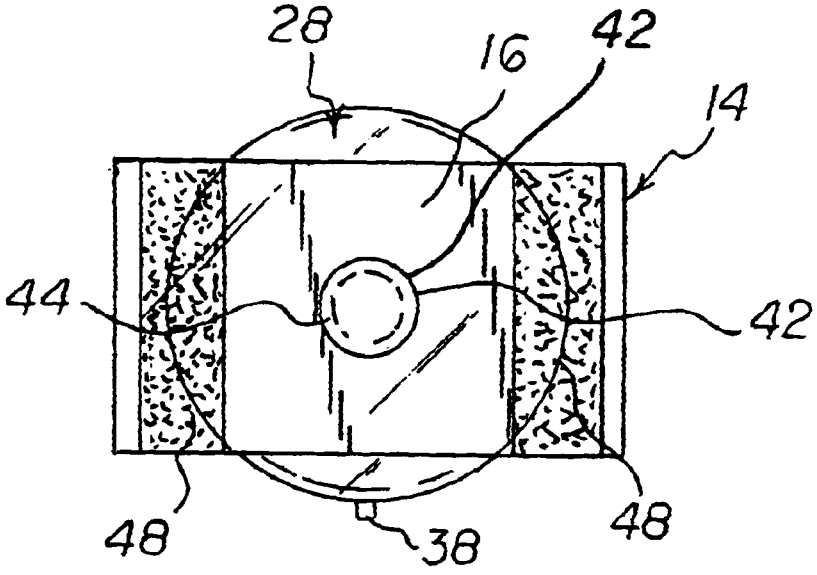
FIG. 4 is a front elevation of the invention taken along line 4—4 of FIG. 3.

With reference now to the drawings, and in particular to FIG. 1 thereof, the preferred embodiment of the new and improved toll pass display system embodying the principles and concepts of the present invention and generally designated by the reference numeral 10 will be described.

The present invention, the toll pass display system 10 is comprised of a plurality of components. Such components in their broadest context include a mounting plate, a suction cup, a pair of hook and loop fasteners and a coupler. Such components are individually configured and correlated with respect to each other so as to attain the desired objective.

First provided is a mounting plate 14. The mounting plate is fabricated of a relatively hard transparent elastomeric material. The preferred material is a clear acrylic. It has a generally rectangular configuration with a front surface 16 and a rear surface 18. There is also a long top edge 20 and a parallel bottom edge 22 and two parallel side edges 24 there between. The mounting plate has a horizontal width between the side edges of between about 3 and 4 inches, preferably about 3.5 inches. It has a vertical height between the top and bottom edges of between about 1.5 and 2.5 inches, preferably about 2 inches. The mounting plate has a central aperture there through. Next provided is a suction cup 28 which is fabricated of a flexible transparent elastomeric material. The preferred material is an ultraviolet (UV) resistant polyvinyl chloride (PVC) compound, light diffusing safety ring, so there is no hot focal point to damage nearby surfaces for UV and heat protection of the pass. The suction cup has an internal generally spherical concave surface 30 and an external generally spherical convex surface 32. There is provided a round circumferential edge 34 there between. The concave depth of the suction cup is between about 0.25 and 0.75 inches in depth, and preferably about 0.50 inches. The round circumferential edge has a diameter of between about 2.0 and 2.75 inches, and preferably about 2.25 inches. The round circumferential edge is greater than the plate height but less the plate width.

Next there is provided a gripping tab 38 extending radially outwardly from the round circumferential side edge of the suction cup. The tab is integrally formed with the suction cup and protrudes laterally between about 0.125 and 0.375 inches, and preferably about 0.25 inches from the round circumferential side edge in a direction parallel with the side edges of the suction cup.

There is next provided a suction cup coupler 42 which is fabricated of the same type of flexible elastomeric material as the suction cup. It is formed integrally therewith. The coupler has a front section 44 coupled to the center of the convex surface of the suction cup and a rear section 46 extending through the aperture of the mounting plate. The suction cup, tab and coupler are fabricated of a flexible elastomeric material with an additive to extend performance during prolonged exposure to heat and sunlight. The mounting plate is fabricated of a rigid transparent elastomeric material.

There is next provided a pair of hook and loop fastener strips 48. The strips are coupled to the front surface of the mounting plate and extend from between adjacent to the bottom edge and adjacent to the top edge of the mounting plate. Each strip is between about 0.25 and 0.75 inches in width, preferably about 0.50 inches. Such fasteners are preferably fabricated of a transparent elastomeric material.

Lastly there is provided a generally rectangular toll card 50. The card in combination with the holder assembly constitutes the system. The card has a front 52 and a rear 54. There is also an upper edge 56 and parallel lower edge 58 and two parallel side edges 60 there between. The toll card has a pair of hook and loop fastener strips 62 on the rear face to releasably mate with and attach to the hook and loop fastener strips of the mounting plate. The card is able to be scanned by an electronic device as the card passes through a toll booth scanning station. The card is also readily separable from the mounting plate when a driver leaves the vehicle in which it is mounted, to facilitate security of the card.

Shown in FIG. 6 is an alternate embodiment of the invention. The primary embodiment is for regions where toll cards are displayed on the inside of the front window. The alternate embodiment of FIG. 6 is for regions where toll cards are displayed on the dashboard. Further, with regard to alternate embodiments, it should be appreciated that the suction cup could be mounted directly to the toll pass, in either a permanent or removable manner. To that end, the suction cup could be secured permanently by an adhesive, removably by pile-type fasteners or through a hole or recess formed in the toll pass.

The toll pass display assembly and/or system may be considered a toll pass caddy. It was designed to solve the inefficiencies of the usual toll pass mounting mechanisms. Electronic toll collection (ETC) technology is the process where account information on an electronic tag (Pass) installed in a vehicle is read by a receiving antenna at toll plazas. The toll is electronically deducted from the motorist's prepaid toll account.

The electronic tag is normally sold to consumers with four pieces of adhesive backed hook and lop tape. The tag itself comes with two pieces of the hook and lop tape attached to it. The consumer is then required to permanently affix two additional pieces of the hook and loop adhesive backed tape to the windshield of the vehicle around the area of the rear view mirror. The tag is then attached to the hook and loop surfaces of this tape when the tag is in use. When the tag is not in use, two pieces of hook and loop tape remain permanently affixed to the windshield of the vehicle.

The problems of this current system are many. The tape is an unsightly permanent addition to the windshield when the tag is not in use. As such, it causes an unnecessary distraction to the motorist when the tag is not in use. The tape acts as a signal for intruders to be aware that the vehicle may contain a toll pass with an account balance, causing the intruder to break into the vehicle to obtain the pass. Permanently affixed mounting mechanisms make it difficult to transport the tag to other vehicles in cases of motorists who own more than one vehicle. If the pass is not mounted properly, or the motorist elects to hold the pass in his or her hand as they drive through the toll plaza, there may be an erroneous reading of the pass and a failure of the ETC system.

The present invention is designed to solve the multitude of problems associated with the current system. The invention is easily placed and removed by a one handed operation. The system is relatively inexpensive to manufacture. The system is compatible with currently utilized mounting systems. There is no overall alteration of the appearance of the toll pass. The removal of the system from the windshield decreases the distraction to the driver. The position of the toll pass display system is easily adjustable, and allows the utilization of one pass by a multitude of vehicles.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A toll pass display system for removably retaining a toll pass in position for being scanned when driving a vehicle through a toll booth comprising, in combination;

a mounting plate fabricated of a transparent elastomeric material and having a generally rectangular configuration with a front surface and a rear surface and with a long top edge and a parallel bottom edge and two parallel side edges there between, the mounting plate having a horizontal width between the side edges of between about 3 and 4 inches, and a vertical height between the top and bottom edges of between about 1.5 and 2.5 inches, the mounting plate having a central aperture there through;

a suction cup fabricated of a flexible transparent elastomeric material having an internal generally spherical concave surface and an external generally spherical convex surface and a round circumferential edge there between, the concave depth being between about 0.25 and 0.75 inches in depth, the round circumferential edge having a diameter of between about 2.0 and 2.75 inches, greater than the plate height but less than the plate width;

a gripping tab physically part of the suction cup extending radially outwardly from the round circumferential side edge of the suction cup, the tab being integrally formed with the suction cup and protruding laterally between about 0.125 and 0.375 inches from the round circumferential side edge in a direction parallel with the side edges;

a suction cup coupler physically part of the suction cup being fabricated of the flexible elastomeric material and formed integrally therewith, the coupler having a front section coupled to the center of the convex surface of the suction cup and a rear section extending through the aperture of the mounting plate;

the suction cup, tab and coupler being fabricated of a transparent flexible elastomeric material with an additive to extend performance during prolonged exposure to heat and sunlight with the mounting plate being fabricated of a rigid elastomeric material;

a pair of transparent hook and loop fastener strips coupled to the front surface of the mounting plate and extending from the bottom edge to the top edge of the mounting plate, each said strip being between about 0.25 and 0.75 inches in width; and a generally rectangular toll card having a front and a rear and an upper edge and parallel lower edge and two parallel side edges there between, and having a pair of hook and loop fastener strips on the rear face to releasably mate with and attach to the hook and loop fastener strips of the mounting plate, the card being scannable by an electronic device as the card passes through a toll booth scanning station, the card also being readily separable from the mounting plate when a driver leaves the vehicle in which the card is mounted to facilitate security of the card.

* * * * *